US008523049B2

(12) United States Patent
Fitzwater

(10) Patent No.: US 8,523,049 B2
(45) Date of Patent: Sep. 3, 2013

(54) SEALED CLAMSHELL CARTON

(75) Inventor: Kelly R. Fitzwater, Lakewood, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 18 days.

(21) Appl. No.: 13/209,655

(22) Filed: Aug. 15, 2011

(65) Prior Publication Data

US 2012/0037692 A1 Feb. 16, 2012

Related U.S. Application Data

(60) Provisional application No. 61/401,593, filed on Aug. 16, 2010.

(51) Int. Cl.
*B65D 5/66* (2006.01)
*B65D 5/68* (2006.01)

(52) U.S. Cl.
USPC ... 229/146; 229/114; 229/125.35; 229/162.7; 229/169

(58) Field of Classification Search
USPC ..... 229/114, 120.09, 120.17, 125.35, 229/162.7, 169, 182, 186, 146
See application file for complete search history.

(56) References Cited

U.S. PATENT DOCUMENTS

| | | | | |
|---|---|---|---|---|
| 1,048,577 A | | 12/1912 | Pardoe | |
| 2,054,596 A | | 9/1936 | Ford | |
| 2,091,126 A | * | 8/1937 | Speer | 229/120.17 |
| 2,180,808 A | | 11/1939 | Jacobstein et al. | |
| 2,194,220 A | | 3/1940 | Elder | |
| 2,337,654 A | * | 12/1943 | Goodyear | 229/145 |
| 2,852,177 A | * | 9/1958 | Frasch | 229/120.09 |
| 2,862,612 A | * | 12/1958 | Brown | 229/146 |
| 2,877,736 A | | 3/1959 | Simmons | |
| 2,924,371 A | * | 2/1960 | Frankenstein | 229/162.7 |
| 3,071,882 A | | 1/1963 | Eisman et al. | |
| 3,099,381 A | | 7/1963 | Meyers | |
| 3,146,933 A | * | 9/1964 | Moore | 229/160 |
| 3,205,603 A | | 9/1965 | Brumley | |

(Continued)

FOREIGN PATENT DOCUMENTS

| | | |
|---|---|---|
| JP | 08-207174 | 8/1996 |
| JP | 10-101056 | 4/1998 |

(Continued)

OTHER PUBLICATIONS

International Search Report and Written Opinion of the International Searching Authority from Corresponding International Application No. PCT/US2011/047725 mailed Mar. 19, 2012.

*Primary Examiner* — Gary Elkins
(74) *Attorney, Agent, or Firm* — Womble Carlyle Sandridge & Rice, LLP

(57) ABSTRACT

A clamshell carton may be erected from a blank for holding a food product. The blank may include various fold lines and corner features such as gussets or glue tabs that facilitate formation of the blank into the clamshell carton that includes a tray and a lid. The tray may have a bottom panel for supporting a food product. The lid may include a window that allows inspection of the food product held in the carton. The carton may include flanges that project outwardly from the tray and lid. When the carton is closed the flanges may define overlapping pairs that may be sealed together to enclose and seal the food product within the carton.

23 Claims, 5 Drawing Sheets

(56) References Cited

U.S. PATENT DOCUMENTS

| | | | | |
|---|---|---|---|---|
| 3,958,744 | A | 5/1976 | Herglotz | |
| 4,004,691 | A | 1/1977 | Wihksne | |
| 4,076,168 | A * | 2/1978 | Ferri | 229/125.35 |
| 4,472,896 | A | 9/1984 | Brauner et al. | |
| 4,630,733 | A | 12/1986 | Fear | |
| 4,684,023 | A | 8/1987 | Cortopassi | |
| 4,804,137 | A * | 2/1989 | Harby | 229/114 |
| 4,901,457 | A | 2/1990 | Chandler | |
| 4,944,451 | A * | 7/1990 | Forbes, Jr. | 229/120.17 |
| D320,743 | S | 10/1991 | Alexander et al. | |
| 5,058,803 | A | 10/1991 | Gulliver | |
| RE33,979 | E | 6/1992 | Cortopassi | |
| D342,446 | S | 12/1993 | Parker et al. | |
| D346,552 | S | 5/1994 | Krupa | |
| 5,358,176 | A * | 10/1994 | Rigby | 229/240 |
| D365,272 | S | 12/1995 | Krupa et al. | |
| 5,662,265 | A | 9/1997 | Jensen | |
| 5,690,273 | A | 11/1997 | Jensen | |
| 5,697,549 | A | 12/1997 | Yocum | |
| 5,735,454 | A * | 4/1998 | Jensen | 229/125.35 |
| 5,826,781 | A | 10/1998 | Jensen | |
| 6,027,018 | A | 2/2000 | Yocum | |
| 6,041,997 | A | 3/2000 | Jensen | |
| 6,068,181 | A | 5/2000 | Cai | |
| 6,283,364 | B1 * | 9/2001 | Gray, Sr. | 229/149 |
| D458,127 | S | 6/2002 | de Groote | |
| D460,691 | S | 7/2002 | Morris et al. | |
| D467,499 | S | 12/2002 | Garza et al. | |
| D473,787 | S | 4/2003 | Jones, Jr. et al. | |
| D484,043 | S | 12/2003 | Hwang et al. | |
| 6,681,983 | B2 | 1/2004 | Bill-Moore | |
| 2003/0047595 | A1 | 3/2003 | Bill-Moore | |
| 2004/0074953 | A1 | 4/2004 | Yocum | |
| 2007/0267467 | A1 | 11/2007 | Burke et al. | |
| 2007/0267468 | A1 | 11/2007 | Burke et al. | |

FOREIGN PATENT DOCUMENTS

| | | |
|---|---|---|
| JP | 2004-059002 | 2/2004 |
| JP | 2005-170517 | 6/2005 |
| KR | 10-2005-0090313 | 9/2005 |

* cited by examiner

SEALED CLAMSHELL CARTON

CROSS-REFERENCE TO RELATED APPLICATION

This application claims the benefit of U.S. Provisional Patent Application No. 61/401,593, which was filed on Aug. 16, 2010. The disclosure of the referenced application is hereby incorporated herein in its entirety by reference.

FIELD OF THE DISCLOSURE

The present disclosure relates generally to cartons that may be used in food packaging, and more particularly to clamshell cartons having a tray portion and a lid portion hingedly attached together.

BACKGROUND

Cartons may be employed to store food items. It is generally desired to minimize the possibility for contamination of food items within the cartons. Accordingly and for example, the present disclosure provides embodiments of a carton, such as a clamshell carton, configured to define desirable properties, such as by providing improved sealing.

SUMMARY OF THE DISCLOSURE

Briefly described, one aspect of the disclosure is directed to a clamshell carton comprising a tray and a lid that are hingedly connected together such that the lid can be hinged closed over the tray to enclose a food product inside the carton. The tray and lid come into contact with one another when the carton is closed. Flanges project outwardly from the tray and lid, and the flanges of the tray can be sealed by heat, adhesive (e.g., hot-melt adhesive), or otherwise to the flanges of the lid, of vice versa, to provide a substantially sealed barrier between the atmosphere outside the carton and the product inside.

In one embodiment a carton configured to store a food product is provided. The carton may comprise a tray comprising a first tray panel, a plurality of additional tray panels including a plurality of side tray panels, a front tray panel, and a rear tray panel each respectively extending from the first tray panel, and a plurality of tray flanges. At least one of the tray flanges may respectively extend from each of the side tray panels and the front tray panel. The carton may further comprise a lid hingedly coupled to the tray and moveable between an open configuration and a closed configuration. The lid may include a first lid panel, a plurality of additional lid panels including a plurality of side lid panels, a front lid panel, and a rear lid panel each respectively extending from the first lid panel, and a plurality of lid flanges. At least one of the lid flanges may respectively extend from each of the side lid panels and the front lid panel. The lid flanges may be configured to align with the tray flanges when the lid is in the closed configuration such that a plurality of overlapping pairs of flanges are defined. Further, each of the overlapping pairs of flanges may terminate adjacent another one of the overlapping pairs of flanges.

In an additional embodiment a blank configured to form a carton is provided. The blank may comprise a tray portion and a lid portion. The tray portion may include a first tray panel, a plurality of additional tray panels including a plurality of side tray panels, a front tray panel, and a rear tray panel each respectively extending from the first tray panel, a plurality of tray corner features, and a plurality of tray flanges. At least one of the tray flanges may respectively extend from each of the side tray panels and the front tray panel. The lid portion may include a first lid panel, a plurality of additional lid panels including a plurality of side lid panels, a front lid panel, and a rear lid panel each respectively extending from the first lid panel, a plurality of lid corner features, and a plurality of lid flanges. At least one of the lid flanges may respectively extend from each of the side lid panels and the front lid panel. The lid flanges may be configured to align with the tray flanges to define a plurality of overlapping pairs of flanges.

In another embodiment a method for forming a carton, such as from the above-discussed blank, is provided. The method may comprise forming a tray and a lid. The forming of the tray may include respectively coupling each of the additional tray panels to an adjacent one of the additional tray panels with the tray corner features. The forming of the lid may include respectively coupling each of the additional lid panels to an adjacent one of the additional lid panels with the lid corner features. The tray and lid flanges may be folded outwardly. There may be relative movement between the tray and the lid so that the folded outwardly lid flanges and the folded outwardly tray flanges respectively cooperate to define a plurality of overlapping pairs of flanges. The overlapping pairs of flanges may be respectively connected together. More specifically, heat and pressure may be applied to the overlapping pairs of flanges to activate hot-melt adhesive and respectively bond the overlapping pairs of flanges together.

Thus, in accordance with various embodiments, a carton may be formed which may be sealed shut at overlapping pairs of flanges. Accordingly, evidence of tampering may be visible. Further, a window may be provided in the carton to allow for inspection of a product stored in the carton. Other aspects of this disclosure will become apparent from the following.

BRIEF DESCRIPTION OF THE DRAWINGS

According to common practice, the various features of the drawings discussed below are not necessarily drawn to scale and may be shown schematically. Dimensions of various features and elements in the drawings may be expanded or reduced to illustrate more clearly the embodiments of the disclosure.

Corresponding parts are designated by corresponding reference numbers throughout the drawings.

DETAILED DESCRIPTION

Figure 3:
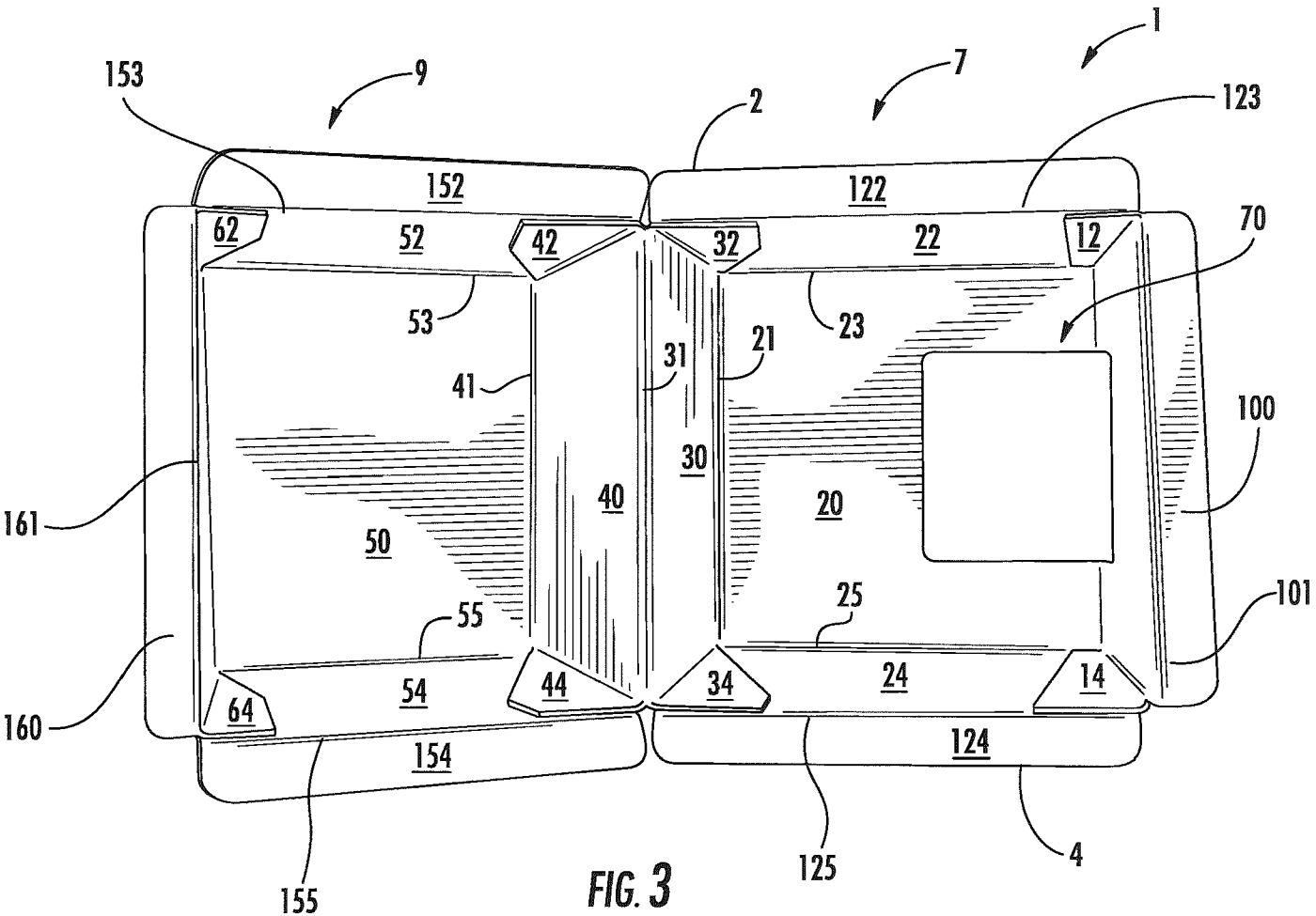
FIG. 3 is a top view of a partially erected clamshell carton illustrating interior portions thereof, according to the first embodiment of the disclosure.
Figure 4:
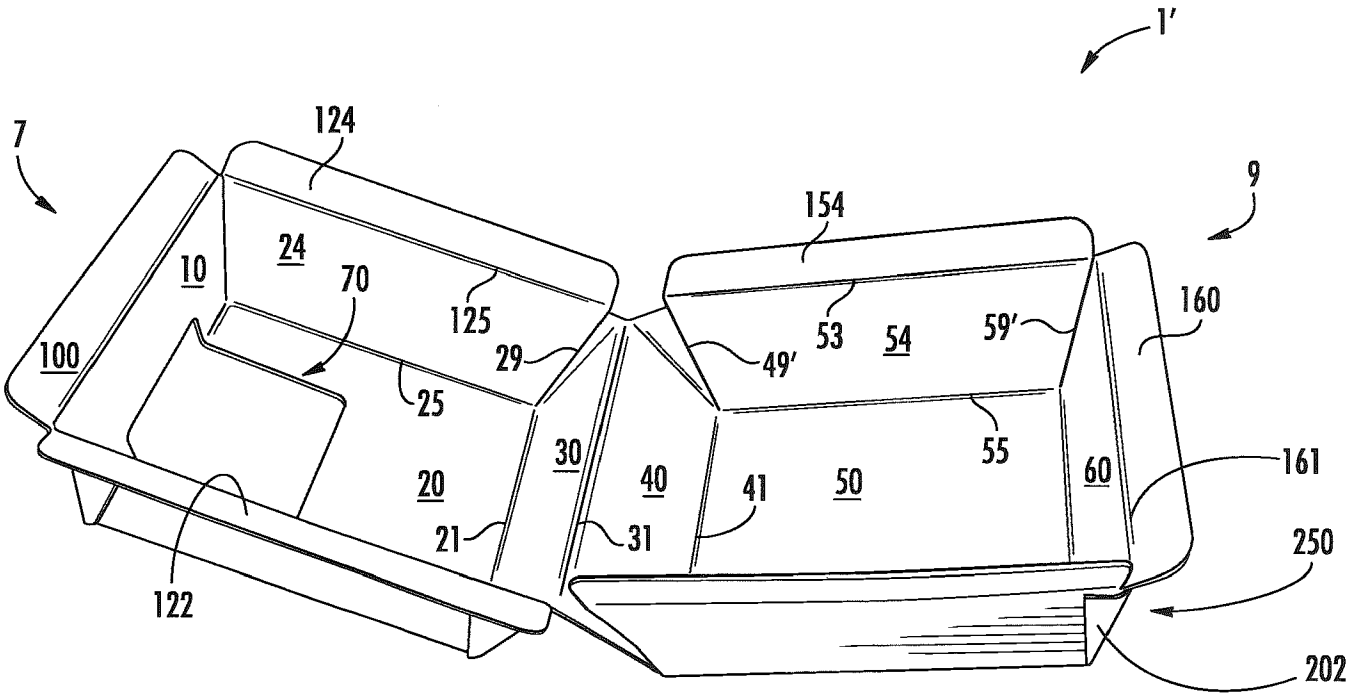
FIG. 4 is a perspective view of a partially erected clamshell carton including interior portions thereof, according to the second embodiment of the disclosure.
Figure 5:
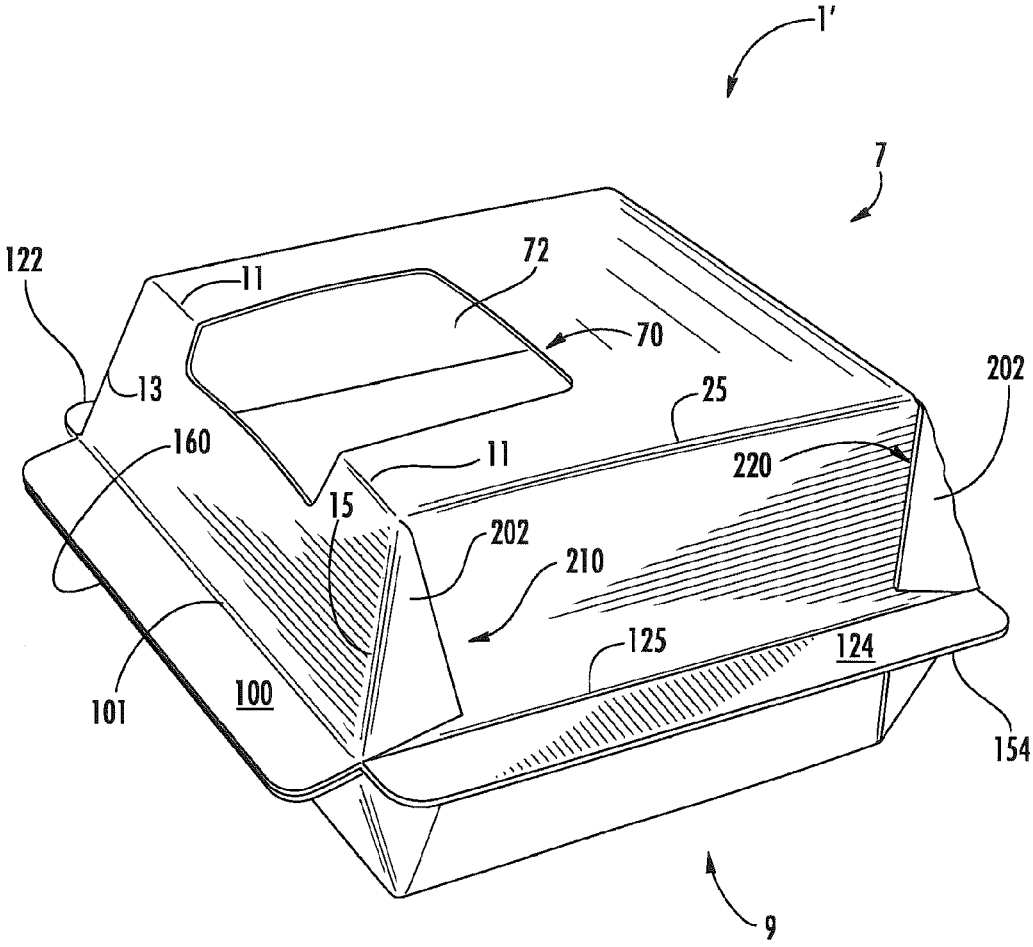
FIG. 5 is a perspective view of a fully erected and closed clamshell carton, according to the second embodiment of the disclosure.

Referring briefly to FIGS. 3-5, exemplary embodiments of a clamshell carton 1, 1' comprise a lid 7 and a tray 9. The lid 7 and the tray 9 are hingedly connected together and form two clamshell portions of the clamshell carton 1, 1'. One or more food products, (not shown) or other types of products, can be contained within the clamshell carton 1, 1' when it is closed. The food products can be contained in packaging and then placed in the clamshell carton 1, 1' or the food products can be placed directly in the clamshell carton for storage, display, and/or heating. The clamshell carton 1, 1' may be acceptable for storage and display of any appropriate type of food product including frozen, refrigerated, or non-refrigerated food products. Exemplary embodiments of the clamshell carton 1, 1' in accordance with this disclosure will first be described in terms of the paperboard blanks from which they are erected.

Figure 1:
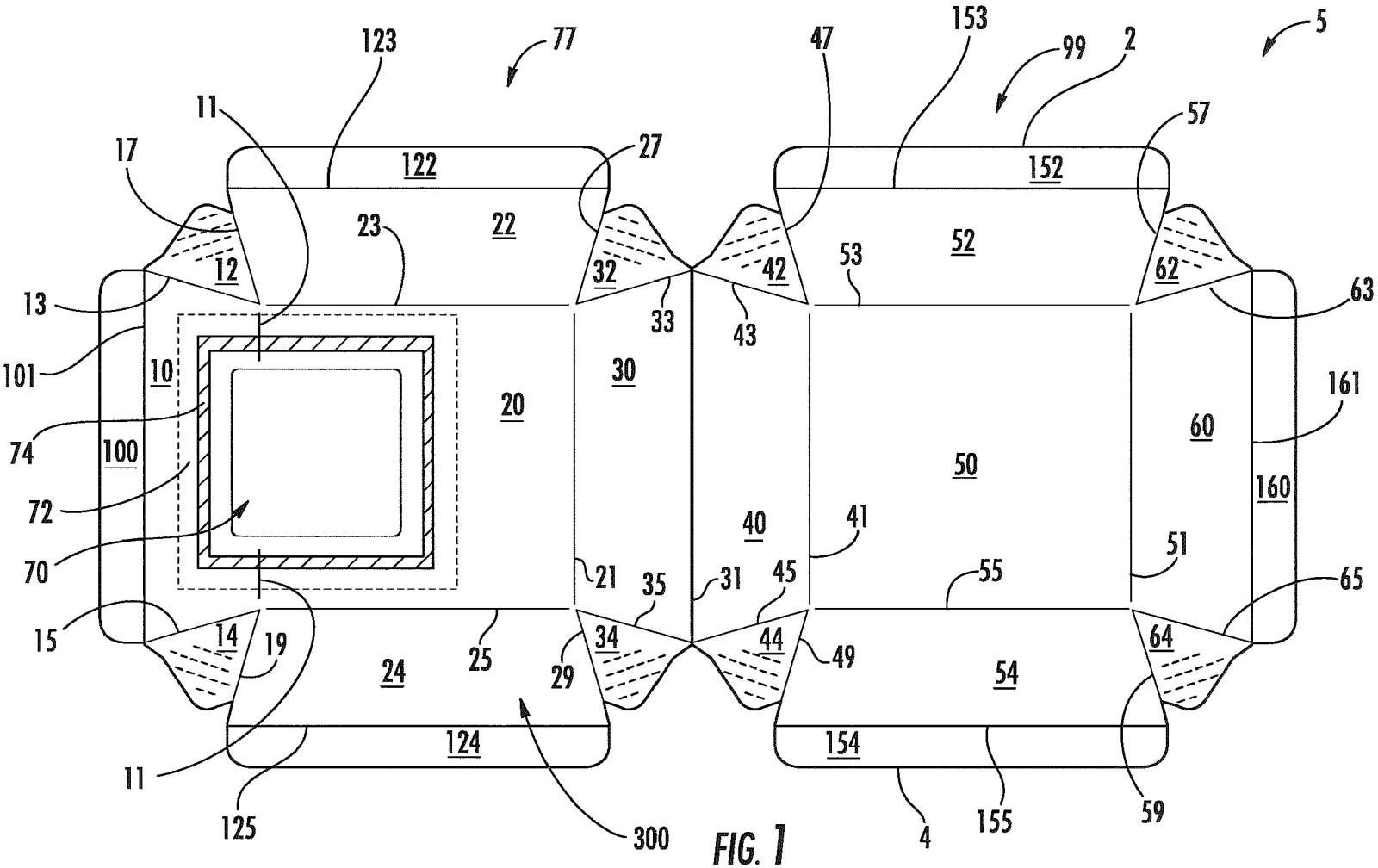
FIG. 1 is a plan view of a blank configured to form a clamshell carton according to a first example embodiment of the disclosure.

In this regard, FIG. 1 illustrates a plan view of a blank 5 which may be used to form a clamshell carton in accordance with a first embodiment. The blank 5 may include a first surface 300 and a second surface on an opposing side of the blank. The first surface 300 may at least partially define an outer surface when the blank is formed into a clamshell carton, and the second surface may define an inside surface. The blank 5 has an outer edge that may be considered to define a first edge portion 2 (e.g., along the top of the blank) and a second edge portion 4 (e.g., along the bottom of the blank).

Further, the blank 5 may comprise a number of panels interconnected by fold lines or other suitable lines of weakening. Generally, the blank 5 may include a lid portion 77 and a tray portion 99 which may be connected by a fold 31. The lid portion 77 and the tray portion 99 may be configured to respectively define a lid and a tray.

More specifically, the lid portion 77 may comprise an upper front panel 10 (e.g., the front lid panel) foldably connected along fold line 11 to a top panel 20. The top panel 20 is foldably connected along fold line 21 to upper rear panel 30 (e.g., the rear lid panel). Upper side panels 22, 24 (e.g., the side lid panels) are respectively foldably connected to the top panel 20 along respective fold lines 23, 25. Thus, the lid portion 77 may be considered to define a first lid panel (e.g., the top panel 20) and a plurality of additional lid panels (e.g., the upper front panel 10, upper rear panel 30, and upper side panels 22, 24).

The tray portion 99 may include a lower rear panel 40 (e.g., the rear tray panel) that is foldably connected to the upper rear panel 30 of the lid portion 77 along fold line 31. The lower rear panel 40 is foldably connected along fold line 41 to a bottom panel 50. The bottom panel 50 is foldably connected along fold line 51 to a lower front panel 60 (e.g., the front tray panel). Further, lower side panels 52, 54 (e.g., side tray panels) are respectively foldably connected to the bottom panel 50 along respective fold lines 53, 55. Thus, the tray portion 99 may be considered to define a first tray panel (e.g., the bottom panel 50) and a plurality of additional tray panels (e.g., the lower front panel 60, lower rear panel 40, and lower side panels 52, 54).

A glue tab 12 (e.g., a flap for being attached, such as with adhesive material) may be connected to the upper front panel 10 along fold line 13. The glue tab 12 may abut, but remain separated from (e.g., disconnected from), upper side panel 22 due to a cut line 17 being positioned therebetween. Similar glue tabs 32, 42, 62 (e.g., flaps for being attached, such as with adhesive material) are connected along fold lines 33, 43, 63 to upper rear panel 30, lower rear panel 40, and lower front panel 60, respectively. The glue tab 32 extends to but is separated from upper side panel 22 along cut line 27, glue tab 42 extends to but is separated from lower side panel 52 along cut line 47, and glue tab 62 extends to but is separated from lower side panel 52 along cut line 57. A mirror image of this glue tab configuration may be formed along the opposite second edge portion 4 of the blank 5 where glue tabs 14, 34, 44, 64 (e.g., attachment flaps) are connected along fold lines 15, 35, 45, 65 to upper front panel 10, upper rear panel 30, lower rear panel 40, and lower front panel 60. Glue tabs 14, 34 extend to but are separated from upper side panel 24 along respective cut lines 19, 29 while glue tabs 44, 64 extend to but are separated from lower side panel 54 along cut lines 49, 59. Each of the above-discussed cut lines may be in the form of a slit.

In one embodiment, when the side 22, 24, 52, 54, front panels 10, 60, and rear panels 30, 40 of the tray portion 99 and of the lid portion 77 are folded toward one another, the glue tabs move or tuck inwardly to overlie partially the inner surfaces of their respective adjacent side panels, to which they can be attached via adhesive (or other material or method) to form the clamshell configurations of a tray and a lid (e.g., tray 9 and lid 7). Alternatively, the glue tabs may be adhesively or otherwise attached to the exterior surfaces of the respective side panels. Thus, glue tabs, or other corner features, may be configured to respectively attach the additional lid panels (e.g., the upper front panel 10, upper rear panel 30, and upper side panels 22, 24) to adjacent ones of the additional lid panels and/or respectively attach the additional tray panels (e.g., the lower front panel 60, lower rear panel 40, and lower side panels 52, 54) to adjacent ones of the additional tray panels.

In one embodiment of the disclosure, an upper front flange panel 100 of the lid portion 77 is foldably connected to the upper front panel 10 along fold line 101 and side flange panels 122, 124 are foldably connected to upper side panels 22, 24 along respective fold lines 123, 125. In similar fashion, a lower front flange panel 160 of the tray portion 99 is foldably connected to the lower front panel 60 along fold line 161 and lower side flange panels 152, 154 are foldably connected to lower side panels 52, 54 along respective fold lines 153, 155. The fold lines 101, 123, 125 form a lip of a lid (e.g., lid 7) when the blank 5 is erected into a clamshell carton (e.g., clamshell carton 1, 1'), while fold lines 153, 155, 161 form a lip of a tray (e.g., tray 9). The flange panels 100, 122, 124 of the lid portion 77 (which may be referred to as lid flanges) may then project outwardly from the lip of the lid to overlie (e.g., overlap, align with) the flange panels 160, 152, 154 of the tray portion 99 (which may be referred to as tray flanges) around the front and sides when the blank is assembled into the clamshell carton.

Optionally, the blank 5 can include an opening 70 that allows one to view the contents within the interior of the clamshell carton and/or permit assessment of the food item or items inside the clamshell carton when the clamshell carton is assembled from the blank. The food item(s) or other item(s) can be disposed in a separate bag if desired, or the item(s) may simply be disposed directly in the clamshell carton. The opening 70 can be covered by a film, plastic, or other covering 72 made of a material that forms a window to allow the product to be viewed or otherwise inspected or assessed therethrough. The covering 72 may be connected to the first surface 300 (e.g., the outside surface) or the second surface (e.g., the inside surface) of blank 5 by an adhesive 74 (or other appropriate means or method) to cover and also to seal the opening 70. The opening 70 is shown in FIG. 1 extending into the top panel 20, across fold line 11, and into upper front panel 10. The opening 70 could be otherwise shaped, arranged, sized, and/or configured, or could be omitted without departing from the disclosure. Optionally, opening 70 can comprise multiple openings, which can be covered by a single covering 72 or which can be covered by multiple coverings, or the opening can be a single opening covered by more than one covering. Optionally still, the covering 72 can be formed in any orientation, size, or configuration, and can be provided in any color, texture, or pattern.

Figure 2:
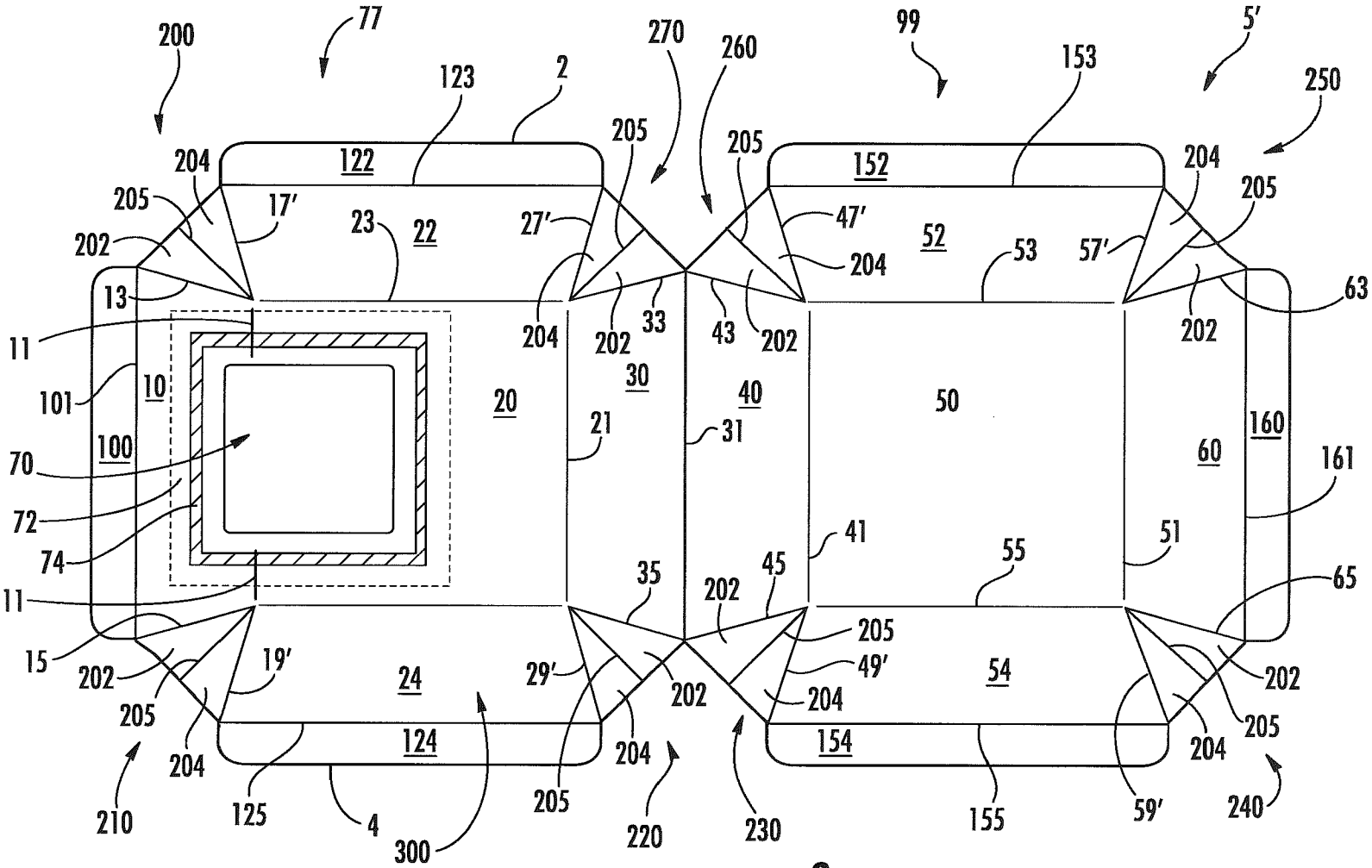
FIG. 2 is a plan view of a blank configured to form a clamshell carton, according to a second example embodiment of the disclosure.

In another embodiment illustrated in FIG. 2, a blank 5' may include features of the blank 5 illustrated in FIG. 1, and therefore the same reference numbers are used when appropriate to identify common features. Thus, as described above, the blank 5' may include a lid portion 77 and a tray portion 99 which may be connected by a fold 31. The lid portion 77 and the tray portion 99 may be configured to respectively define a lid and a tray. Further, the blank 5' may optionally include the opening 70, as described above with respect to the blank 5 of the first embodiment. In one embodiment, the top and bottom panels 20, 50; front panels 10, 60; rear panels 30, 40; side panels 22, 24, 52, 54; and flange panels 122, 124, 152, 154 are identical to the same panels of the embodiment shown in FIG. 1.

In this embodiment, however, the corner features comprise foldable gussets 200, 210, 220, 270 that span the space between the front and rear panels and their adjacent side panels and connect these panels together, rather than the glue tabs of FIG. 1. More specifically, the gussets 200, 210 connect the upper side panels 22, 24 of the lid portion 77 to upper front panel 10, and the gussets 220, 270 connect the upper side panels 22, 24 to upper rear panel 30. Similarly for the tray portion 79, foldable gussets 230, 240, 250, 260 connect lower side panels 52, 54 of the tray portion to lower rear and lower front panels 40, 60 respectively of the tray portion.

In one embodiment, each gusset 200, 210, 220, 230, 240, 250, 260, 270 comprises a first gusset panel 202 foldably connected to a second gusset panel 204 along an oblique fold line 205. The gussets 200, 210, 220, 230, 240, 250, 260, 270 are connected to respective side panels and to front and rear panels as the case may be along fold lines. More specifically, gusset 200 is connected to upper side panel 22 along fold line 17' and to upper front panel 10 along fold line 13, and gusset 210 is connected to upper front panel 10 along fold line 15 and to upper side panel 24 along fold line 19'. Gusset 220 is connected to upper side panel 24 along fold line 29' and to upper rear panel 30 along fold line 35, and gusset 230 is connected to lower rear panel 40 along fold line 45 and to lower side panel 54 along fold line 49'. Gusset 240 is connected to lower side panel 54 along fold line 59' and to lower front panel 60 along fold line 65, and gusset 250 is connected to lower front panel 60 along fold line 63 and to lower side panel 52 along fold line 57'. Gusset 260 is connected to lower side panel 52 along fold line 47' and to lower rear panel 40 along fold line 43, and gusset 270 is connected to upper rear panel 30 along fold line 33 and to upper side panel 22 along fold line 27'.

The gusset panels 202, 204 may define generally triangular panels, and the gusset panels may be separated by fold lines 205. However, the gussets, gusset panels, and fold lines could be otherwise shaped, arranged, and positioned without departing from the disclosure. In some embodiments, fewer gussets overall may be required and in other embodiments a combination of gussets and panels may be used to form the carton. It will be appreciated that the tray 7 and the lid 9 can be formed by bringing the side 22, 24, 52, 54 and front and rear panels 10, 60, 30, 40 of the tray portion 77 and the lid portion 99 toward one another with the gusset panels 202, 204 folding along fold line 205. The gussets 200, 210, 220, 230, 240, 250, 260, 270 can then be glued and/or otherwise secured in their folded configurations. Further, the gussets 200, 210, 220, 230, 240, 250, 260, 270 may be glued to the interior or exterior of an adjacent panel. The gussets 200, 210, 220, 230, 240, 250, 260, 270 may provide a greater barrier seal or an improved barrier seal between the exterior and interior of a carton formed from the blank 5' because of their continuous nature spanning the various panels 10, 22, 24, 30, 40, 52, 54, 60. However, as noted above, one or more of the gussets could be otherwise shaped, arranged, and/or configured without departing from the disclosure.

In one embodiment, the flange panels 100, 122, 124, 152, 154, 160 are generally rectangular in profile and can extend an entire length of a respective side panel 22, 24, 52, 54 or respective front panel 100, 160 at a respective fold line 101, 123, 125, 153, 155, 161. When a carton is erected from an embodiment of the blanks 5, 5' disclosed herein and folded shut with the lid overlying the tray, opposing flange panels (e.g., 100 and 160, 122 and 124, 152 and 154) are in contact with each other and can be secured together in any suitable manner, such as, for example, with an appropriate adhesive (e.g., hot-melt adhesive), one or more mechanical fasteners, and/or in any other suitable manner For example, a hot-melt adhesive may be provided on respective ones of the flanges, and the respective flanges may be pressed together with a hot iron, or otherwise be pressed together and heated in any other suitable manner, so that the hot-melt adhesive is activated and thereafter cools and bonds the respective flanges together. The flanges may be respectively secured together in any other suitable manner.

Opposing flange panels may have a similar size in order to maximize a contact area between opposing flange panels and improve a resulting seal between the lid and the tray formed from the lid portion 77 and the tray portion 99. The flange panels 100, 122, 124, 152, 154, 160 can have any length and any width necessary to establish an adequate barrier and a seal for the product inside the clamshell carton formed from the blank 5, 5'. In some embodiments, a typical flange panel length can range from 3.5 to 5.5 inches and a typical flange panel width can range from 0.25 to 1.00 inches. In other embodiments, the flange panels may have a length greater than a width of the side panel or a front panel (e.g., wherein the length of the flange panels and the width of the side and front panels extend along the fold line therebetween). When the flange panels 100, 122, 124, 152, 154, 160 are overlapped and sealed, a barrier is created between the exterior of the carton and the interior of the carton to help maintain the freshness and safety of the food items within the carton. Further, the sealed flange panels may function as a tamper indicator that, if breached, may indicate that the contents of the interior of the carton have been compromised.

In one exemplary method, the first embodiment of the blank 5 may be formed into the corresponding first embodiment of a carton 1 illustrated in FIG. 3, in which a second surface 400 that defines an outer surface of the carton is shown . In particular, the carton 1 can be erected from the blank 5 by folding the respective side panels, front panels, and rear panels toward each other along the connecting fold lines to form the lid 7 and tray 9, as may be understood with reference to FIGS. 1 and 3. At the first edge portion 2 of lid portion 77, glue tab 12 is folded along fold line 13 and tucked under or inside side panel 22, and glue tab 32 is folded along fold line 33 and tucked inside upper side panel 22. At the second edge portion 4 of lid portion 77, glue tab 14 is folded along fold line 15 and tucked inside upper side panel 24, and glue tab 34 is folded along fold line 35 and tucked inside upper side panel 24. Upper front panel 10 is folded along fold line 11, upper rear panel 30 is folded along fold line 21, upper side panel 22 is folded along fold line 23, and upper side panel 24 is folded along fold line 25. An adhesive (e.g., a glue or a heat sealed adhesive) is applied to, or otherwise activated at, the glue tabs 12, 32, 14, 34, and/or to the corresponding upper side panels 22, 24, respectively, to secure the glue tabs in place to form the lid 7. For example, an adhesive may be applied to, or otherwise activated at, the first surface 300 (e.g., the outer surface) at the glue tabs 12, 32, 14, 34 and/or to a second surface (e.g., the inner surface, opposing the first surface) at the corresponding upper side panels 22, 24. In FIG. 1, adhesive material is schematically illustrated by dashed lines on the glue tabs.

Similarly, at the first edge portion 2 of tray portion 99, glue tab 42 is folded along fold line 43 and tucked inside side panel 52, and glue tab 62 is folded along fold line 63 and tucked inside side panel 52. At the second edge portion 4 of tray portion 99, glue tab 44 is folded along fold line 45 and tucked inside side panel 54, and glue tab 64 is folded along fold line 65 and tucked inside side panel 54. Lower front panel 60 is folded along fold line 51, lower rear panel 40 is folded along fold line 41, side panel 52 is folded along fold line 53, and side panel 54 is folded along fold line 55. An adhesive (e.g., a glue or a heat sealed adhesive) may be applied to the first surface 300 (e.g., the outer surface) at glue tabs 42, 62, 44, 64, and/or to the second surface (e.g., opposite the first surface) at corresponding sections of lower front panel 60, side panel 52, lower rear panel 40, and side panel 54, respectively, to secure the glue tabs in place to form the tray 9. Note that although the glue tabs are generally shown and described above as being folded inside of the corresponding panels such that the glue tabs are positioned on the inside of the carton 1, the glue tabs may alternatively be folded outside of the corresponding panels such that the glue tabs are positioned outside the carton. In this regard, adhesive may be applied to, or otherwise activated at, the first surface 300 (e.g., the outer surface) of the panels or the second surface (e.g., the inner surface, which opposes the first surface) at the glue tabs in embodiments in which the glue tabs are folded outside of the corresponding panels.

The second embodiment of the blank 5' (see, FIG. 2) may be formed into a carton 1' of a second embodiment, as illustrated in an open configuration in FIG. 4. In order to form the carton 1', two clamshell portions, lid 7 and tray 9, are formed by folding the various side, front, and back panels along connecting fold lines, as may be understood with reference to FIGS. 2 and 4. At the first edge portion 2 of lid portion 77, gusset panels 202, 204 of gusset 200 are folded along fold lines 13, 17', 205 extend from the first surface 300 (e.g., the gusset panels may be folded toward one another such that the gusset is positioned on the outside of the carton 1'), and gusset panels 202, 204 of gusset 270 are folded along fold lines 33, 27', 205 toward the first surface 300. At the second edge portion 4 of tray portion 99, gusset panels 202, 204 of gusset 210 are folded along fold lines 15, 19', 205 toward the first surface 300, and gusset panels 202, 204 of gusset 220 are folded along fold lines 35, 29', 205 toward the first surface 300. Upper front panel 10 is folded along fold line 11, upper rear panel 30 is folded along fold line 31, upper side flap 22 is folded along fold line 23, and upper side flap 24 is folded along fold line 55. An adhesive (e.g., glue or a heat sealed adhesive) may be applied to, or otherwise activated at, the first surface 300 (e.g., the outer surface) at the gusset panels 204 or at a portion of the first surface at the side panels 22, 24 and the gussets 200, 210, 220, 270 may be folded and secured in place to form the lid 7 of the clamshell carton 1'.

Along the first edge portion 2 of tray portion 99, gusset panels 202, 204 of gusset 250 are folded along fold lines 63, 57', 205 toward the first surface 300 (e.g., the gusset panels may be folded toward one another such that the gusset is positioned on the outside of the carton 1'), and gusset panels 202, 204 of gusset 260 are folded along fold lines 43, 47', 205 and extend outwardly from the first surface 300. At the second edge portion 4 of tray portion 99, gusset panels 202, 204 of gusset 230 are folded along fold lines 45, 49', 205 and extend outwardly from the first surface 300, and gusset panels 202, 204 of gusset 240 are folded along fold lines 59', 65, 205 and extend outwardly from the first surface 300. Lower rear panel 40 is folded along fold line 41, lower front panel 60 is folded along fold line 51, lower side panel 52 is folded along fold line 53, and lower side panel 54 is folded along fold line 55. An adhesive (e.g., a glue or a heat sealed adhesive) may be applied to, or otherwise activated at, the first surface 300 (e.g., the outer surface) of gusset panels 204 or a portion of the first surface at the lower side panels 52, 54 and the gussets 230, 240, 250, 260 folded and secured adhesively in place to form tray 9. Since the gussets are continuous from their respective side panels to their respective front or rear panels, this embodiment may form a better seal than the embodiment of FIG. 1 wherein the glue tabs are separated from the side panels along cut lines (e.g., slits).

Note that although the gussets 200, 210, 220, 230, 240, 250, 260, 270 are generally shown and described above as being folded such that the gusset panels 204 are adhered (e.g., glued, or heat sealed) to the side panels 22, 24, 52, 54, in other embodiments the gussets may be configured such that the gusset panels 202 are adhered to the front 10, 60 or rear 30, 40 panels with adhesive (e.g., a glue or heat seal) applied to, or otherwise activated at, the second surface at the gusset panel 202 or the corresponding portions of the front and rear panels. Further, in another embodiment the gusset panels 202, 204 may be folded inwardly such that the gusset is positioned on the inside of the carton). Accordingly, adhesive (e.g., a glue or heat seal) may be applied to, or otherwise activated at, the second surface at one of the gusset panels 202, 204 and/or the corresponding side 22, 24, 52, 54, front 10, 60 or rear 30, 40 panels.

At any suitable time during the forming of the carton 1, 1', flange panels 100, 122, 124, 152, 154, 160 may be folded outwardly (e.g., away from the inside of the carton) about fold lines 101, 123, 125, 153, 155, 161, respectively.

Once the lid 7 and tray 9 are formed, the lid and tray can be articulated, hinged, or folded toward each other along connecting fold line 31. The lid 7 and tray 9 can be hinged along line 31, to initially close the carton, or can be re-hinged to reclose the carton as desired. Line 31 may be formed as a cut crease or as multiple fold lines that, when folded, offers relief to the area of and surrounding line 31 to eliminate fight back of the carton (such as resistance to opening or closing of the lid 7 and tray 9 with respect to one another). Further, if desired, the lid 7 and tray 9 can be separated along line 31 to form separate portions (providing additional use benefits, such as allowing one portion to be available for use as a bottom tray or insulation surface or to provide separate trays for food items, condiments, or the like). That is, the fold line 31 (or one or more portions thereof) may optionally be a tear line. Alternatively, the fold line 31 may be a cut line (e.g., slit), and flange panels that are for being connected to one another (e.g., for being sealed together) may be respectively foldably connected to the lower rear panel 40 and the lower front panel 60.

Once folded along line 31, the lid 7 and tray 9 can be disposed in a closed configuration as shown in FIG. 5 to enclose a food item in the resulting carton. Although the second embodiment of the carton 1' is illustrated in FIG. 5, the first embodiment of the carton 1 is also configurable to the closed configuration. In the closed configuration, opposing flange panels, e.g., 100 and 160, 122 and 124, 152 and 154 project outwardly from the tray and lid to overlap one another and can be aligned. Thus, the lid flanges 100, 122, 124 may align with the tray flanges 160, 152, 154 when the lid 7 is in the closed configuration such that a plurality of overlapping pairs of flanges 100 and 160, 122 and 124, 152 and 154 are defined. As further illustrated in FIG. 5, each of the overlapping pairs of flanges 100 and 160, 122 and 124, 152 and 154 terminates adjacent another one of the overlapping pairs of flanges. The overlapping pairs of flanges 100 and 160, 122 and 124, 152 and 154 may be heat sealed or otherwise adhered and/or fastened together to form a barrier or seal between the atmosphere on the exterior of the carton and the food in the interior of the carton, and/or function to provide evidence of tampering. As a more detailed example, for each of the pairs of flanges 100 and 160, 122 and 124, 152 and 154, one or both of the opposite surfaces facing one another may have been previously at least partially coated with a hot-melt adhesive, such as when the blanks 5, 5' where originally manufactured or at any suitable time thereafter. Then, when the overlapping pairs of flanges 100 and 160, 122 and 124, 152 and 154 are defined, for each overlapping pair, the flanges may be simultaneously pressed together and heated, such as with a hot iron, or in any other suitable manner, so that the hot-melt adhesive is activated and thereafter cools and bonds the respective flanges together. Cartons 1, 1' can be formed, closed, and/or opened by other alternative methods and steps without departing from the disclosure.

Blank 5, 5' can be provided in any size or configuration as desired, with one exemplary embodiment including a length between flange panel 100 and flange panel 160 of about 13.75-inch, a width between peripheral portions of flange panels 122, 152 and flange panels 124, 154 of about 7.375-inch, and a width between peripheral portions of side panels 22, 24 and side panels 52, 54 for about 6.375-inch. In this example, panel 20 has a width between fold lines 23, 25 of 3.625-inch, side panel 22 has a width from fold line 23 to fold line 123 of 1.375-inch, and side panel 24 has a width from fold line 25 to fold line 125 of 1.375-inch. Also, in this example, bottom panel 50 has a width between fold line 53 and fold line 55 of 3.625-inch, side panel 52 has a width from fold line 53 to fold line 153 of 1.375-inch, and side panel 54 has a width from fold line 55 to fold line 155 of 1.375-inch. Upper front panel 10 has a length between fold line 11 and fold line 101 of 1.375-inch, top panel 20 has a length between fold line 11 and fold line 21 of 1.375-inch, top rear panel 30 has a length between fold line 21 and line 31 of 1.375-inch, bottom rear panel 40 has a length between line 31 and fold line 41 of 1.375-inch, bottom panel 50 has a length between fold line 41 and fold line 51 of 3.625-inch, and lower front panel 60 has a length between fold line 51 fold line 161 of 1.375-inch. Flange panel 100 has a width between fold line 101 and a peripheral portion of 0.5-inches and has a length of 4.397-inches. Dimensions of flange panels 122, 124, 152, 154, 160 may be substantially similar. These dimensions are provided for exemplary purposes only and should in no manner limit the blank, carton, or package detailed herein. The above-discussed dimensions may each be approximate, and each may vary by a percentage, such as by plus or minus ten, twenty, thirty and/or any other suitable percentage.

The clamshell cartons of the various illustrated embodiments are useful in providing a package for containing a food product, the package comprising a tray and a lid. The tray may be configured to be folded flat and used as a placemat for placing the food product during consumption or storage. The carton is generally a rectangular prism in shape.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there-along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

Directional references (e.g., upper, lower, upward, downward, front, back, left, right, leftward, rightward, top, bottom, above, below, vertical, horizontal, clockwise, and counterclockwise) have been used in this disclosure for ease of understanding and not for the purpose of limiting the scope of this disclosure. Accordingly, while the present disclosure has generally been provided in terms of certain illustrated configurations, directional references related thereto are provided only for example. Also, in considering the scope of this disclosure, each of the features of this disclosure should be considered as applicable in isolation, and in various combinations and subcombinations.

The foregoing description of the disclosure illustrates and describes various exemplary embodiments. Various additions, modifications, changes, etc., could be made to the exemplary embodiments without departing from the spirit and scope of the invention as set forth in the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton configured to store a food product, the carton comprising:

a tray, comprising:

a first tray panel;

a plurality of additional tray panels including a plurality of side tray panels, a front tray panel, and a rear tray panel each respectively extending from the first tray panel; and a plurality of tray flanges, wherein at least one of the plurality of tray flanges respectively extends from each of the side tray panels and the front tray panel; and a lid hingedly coupled to the tray and moveable between an open configuration and a closed configuration, the lid comprising:

a first lid panel;

a plurality of additional lid panels including a plurality of side lid panels, a front lid panel, and a rear lid panel each respectively extending from the first lid panel; and a plurality of lid flanges, wherein at least one of the plurality of lid flanges respectively extends from each of the side lid panels and the front lid panel, wherein the plurality of lid flanges are aligned and in face-to-face contact with the plurality of tray flanges when the lid is in the closed configuration such that a plurality of overlapping pairs of flanges are defined, wherein each of the plurality of tray flanges has a first edge and each of the plurality of lid flanges has a second edge, the first edge and the second edge comprise a respective free edge extending along the entire length of the plurality of overlapping pairs of flanges, wherein a respective first edge is aligned with a respective second edge and each of the aligned first edge and second edge forms a free edge of the carton that extends along the length of the plurality of overlapping pairs of flanges, wherein each of the overlapping pairs of flanges terminates adjacent another one of the overlapping pairs of flanges.

2. The carton of claim 1, further comprising a plurality of corner features that respectively couple each of the additional tray panels to an adjacent one of the additional tray panels and respectively couple each of the additional lid panels to an adjacent one of the additional lid panels, wherein the corner features are respectively positioned between:

the side tray panels and the front tray panel, the side tray panels and the rear tray panel, the side lid panels and the front lid panel, and the side lid panels and the rear lid panel.

3. The carton of claim 2, wherein the corner features of the tray are folded and attached to the side tray panels, and the corner features of the lid are folded and attached to the side lid panels.

4. The carton of claim 3, wherein the corner features comprise a plurality of gussets.

5. The carton of claim 3, wherein the corner features comprise a plurality of tabs.

6. The carton of claim 5, further comprising a plurality of first cut lines and a plurality of second cut lines, wherein a respective cut line of the plurality of first cut lines is positioned between a respective tab of the plurality of tabs and the tray side panels, and a respective cut line of the plurality of second cut lines is positioned between a respective tab of the plurality of tabs and the lid side panels.

7. The carton of claim 1, wherein the lid comprises a window.

8. The carton of claim 7, wherein the window is defined in the first lid panel and the front lid panel.

9. The carton of claim 7, wherein the window comprises a covering configured to allow for viewing therethrough.

10. The carton of claim 1, wherein each of the lid flanges respectively defines a lid flange length and each of the tray flanges respectively defines a tray flange length, wherein the lid flange length is substantially equal to the tray flange length for each of the overlapping pairs of flanges.

11. The carton of claim 1, wherein the lid flanges and the tray flanges are configured to be adhered together as the overlapping pairs of flanges.

12. The carton of claim 11, wherein each of the lid flanges respectively defines a lid flange width and each of the tray flanges respectively defines a tray flange width, wherein the lid flange width is substantially equal to the tray flange width for each of the overlapping pairs of flanges.

13. The carton of claim 1, wherein the lid is coupled to the tray along a fold line.

14. The carton of claim 1, wherein the lid is coupled to the tray along a tear line.

15. A method for forming a carton of claim 1, comprising:

forming the tray having peripheral tray flanges;

folding the tray flanges outwardly;

forming the lid having peripheral lid flanges; and folding the lid flanges outwardly.

16. The method of claim 15, further comprising:

causing relative movement between the tray and the lid so that the folded outwardly lid flanges and the folded outwardly tray flanges respectively cooperate to define the plurality of overlapping pairs of flanges; and respectively connecting the overlapping pairs of flanges together.

17. The method of claim 16, wherein the connecting of the overlapping pairs of flanges together comprises applying heat and pressure to the overlapping pairs of flanges to activate hot-melt adhesive and respectively bond the overlapping pairs of flanges together.

18. The carton of claim 1, wherein each of the plurality of lid flanges are foldably connected to each of the respective plurality of side lid panels along a respective lid flange fold line, the lid flange fold line is free from openings along the entire length of each of the plurality of lid flanges.

19. The carton of claim 1 wherein each of the plurality of tray flanges are foldably connected to each of the respective plurality of side tray panels along a respective tray flange fold line, the tray flange fold line is free from openings along the entire length of each of the plurality of tray flanges.

20. A blank configured to form a carton, the blank comprising:

a tray portion, comprising:

a first tray panel;

a plurality of additional tray panels including a plurality of side tray panels, a front tray panel, and a rear tray panel each respectively extending from the first tray panel;

a plurality of tray corner features positioned between the side tray panels and the front tray panel and between the side tray panels and the rear tray panel and configured to respectively couple each of the additional tray panels to an adjacent one of the additional tray panels; and a plurality of tray flanges, wherein at least one of the plurality of tray flanges respectively extends from each of the side tray panels and the front tray panel; and a lid portion coupled to the tray portion, the lid portion comprising:

a first lid panel;

a plurality of additional lid panels including a plurality of side lid panels, a front lid panel, and a rear lid panel each respectively extending from the first lid panel;

a plurality of lid corner features positioned between the side lid panels and the front lid panel and between the side lid panels and the rear lid panel and configured to respectively couple each of the additional lid panels to an adjacent one of the additional lid panels; and a plurality of lid flanges, wherein at least one of the plurality of lid flanges respectively extends from each of the side lid panels and the front lid panel, wherein the plurality of lid flanges are for being aligned and in face-to-face contact with the plurality of tray flanges to define a plurality of overlapping pairs of flanges, wherein each of the plurality of tray flanges has a first edge and each of the plurality of lid flanges has a second edge, the first edge and the second edge comprise a respective free edge extending along the entire length of the plurality of overlapping pairs of flanges in the carton formed from the blank, wherein the first edge is for being aligned with a respective second edge such that each of the aligned first edge and second edge are for forming a free edge of the carton formed from the blank that extends along the length of the plurality of overlapping pairs of flanges.

21. The blank of claim 20, wherein the lid flanges and the tray flanges are configured to be adhered together.

22. The blank of claim 20, wherein each of the plurality of lid flanges are foldably connected to each of the respective plurality of side lid panels along a respective lid flange fold line, the lid flange fold line is free from openings along the entire length of each of the plurality of tray flanges.

23. The blank of claim 20, wherein each of the plurality of tray flanges are foldably connected to each of the respective plurality of side tray panels along a respective tray flange fold line, the tray flange fold line is free from openings along the entire length of each of the plurality of tray flanges.

* * * * *